US007626801B2

(12) United States Patent
Glaser et al.

(10) Patent No.: US 7,626,801 B2
(45) Date of Patent: Dec. 1, 2009

(54) INTEGRATED INDUCTOR AND CAPACITOR COMPONENTS AND METHODS OF MANUFACTURE

(75) Inventors: John Stanley Glaser, Niskayuna, NY (US); Michael Andrew de Rooij, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 321 days.

(21) Appl. No.: 11/749,174

(22) Filed: May 16, 2007

(65) Prior Publication Data

US 2008/0285205 A1 Nov. 20, 2008

(51) Int. Cl.
*H01F 5/00* (2006.01)
*H01F 27/28* (2006.01)

(52) U.S. Cl. ..... 361/270; 336/223; 29/605

(58) Field of Classification Search ..... 361/270; 336/223; 29/605
See application file for complete search history.

(56) References Cited

U.S. PATENT DOCUMENTS 2,328,443 A * 8/1943 Foster ..... 242/444.5
6,730,183 B2 * 5/2004 Tokuda et al. ..... 156/89.12
6,735,862 B1 5/2004 Glaser et al.
6,956,188 B2 10/2005 de Rooij et al.
7,142,440 B2 11/2006 de Rooij et al.
7,236,060 B2 * 6/2007 Wood ..... 331/57
2004/0108311 A1 6/2004 de Rooij et al.
2004/0129448 A1 7/2004 de Rooij

OTHER PUBLICATIONS

J. T. Strydom et al., "Some limits of integrated LCT modules for resonant converters at 1 MHz," IEEE, vol. 2, Issue 1999, pp. 1411-1417.

* cited by examiner

*Primary Examiner*—Evan Pert
(74) *Attorney, Agent, or Firm*—Penny A. Clarke

(57) ABSTRACT

An integrated inductor and capacitor component is provided and includes a number of tapered conductors. Neighboring ones of the tapered conductors are separated by a gap extending along a length of the component. A first one of the tapered conductors is characterized by a first width w1 that is larger at a first end of the component and tapers along the length of the component toward a second end of the component, and a second one of the tapered conductors is characterized by a second width w2 that is larger at the second end of the component and tapers toward the first end of the component.

26 Claims, 13 Drawing Sheets

INTEGRATED INDUCTOR AND CAPACITOR COMPONENTS AND METHODS OF MANUFACTURE

BACKGROUND

The invention relates generally to electrical components for power conversion, and more particularly, to integrated inductor and capacitor components.

Efforts are ongoing to increase power density for electrical switching power converters. Many switching power converters employ controllable switches in conjunction with capacitive and inductive energy storage elements to convert power from one voltage or current to another in a controlled and efficient manner. As will be recognized by one skilled in the art, capacitive energy storage refers to the storage of electrical energy in an electric field, and inductive energy storage refers to the storage of electrical energy in a magnetic field. Typically, the capacitive and inductive energy storage tasks are performed separately by capacitors and inductors. However, it has been proposed that a single element (an integrated LC component) can integrate both types of energy storage, with the purpose of increasing the power density of power converter circuits. At present, most integrated LC components for use in power converters suffer relatively high losses and hence have not yet achieved practicality.

In most implementations, the integrated LC component has an element that is formed by having two long conductors separated by a dielectric, which forms a capacitor. This pair of conductors may then be formed into a coil, which enhances its ability to function as an inductor. Thus, both capacitive and inductive energy storage occupy the same volume.

One disadvantage of the typical integrated LC component implementation is that the area of the two conductors is constant along their length, but current density is not. This may result in increased losses and larger components than necessary. Another disadvantage is that the typical implementation of the conductors is that of a solid copper plane. This can result in high eddy current losses when the operating frequency is high.

It would therefore be desirable to provide an integrated LC component with a more uniform current distribution and thus lower losses.

BRIEF DESCRIPTION

Briefly, in accordance with one embodiment of the present invention, an integrated inductor and capacitor component is provided. The component comprises a number of tapered conductors. Neighboring ones of the tapered conductors are separated by a gap extending along a length of the component. A first one of the tapered conductors is characterized by a first width w1 that is larger at a first end of the component and tapers along the length of the component toward a second end of the component. A second one of the tapered conductors is characterized by a second width w2 that is larger at the second end of the component and tapers toward the first end of the component.

Another aspect of the invention resides in an integrated inductor and capacitor component that includes a number of tapered conductors arranged to form a loop, wherein neighboring ones of the tapered conductors are separated by a gap. A first one of the tapered conductors is characterized by a first width w1 that is larger at a first end of the loop and tapers along the length of the component toward a second end of the loop. A second one of the tapered conductors is characterized by a second width w2 that is larger at the second end of the loop and tapers toward the first end of the loop.

Another aspect of the invention resides in a method for manufacturing an electrical component. The method includes arranging a number of tapered conductors such that neighboring ones of the tapered conductors are separated by a gap extending along a length of the electrical component. A first one of the tapered conductors is characterized by a first width w1 that is larger at a first end of the component and tapers along the length of the component toward a second end of the component. A second one of the tapered conductors is characterized by a second width w2 that is larger at the second end of the component and tapers toward the first end of the component.

Yet another aspect of the invention resides in an integrated inductor and capacitor component that includes a number of conductors separated by a gap and configured such that a current density is controlled along a length of the component.

DRAWINGS

These and other features, aspects, and advantages of the present invention will become better understood when the following detailed description is read with reference to the accompanying drawings in which like characters represent like parts throughout the drawings, wherein.

Figure 9:
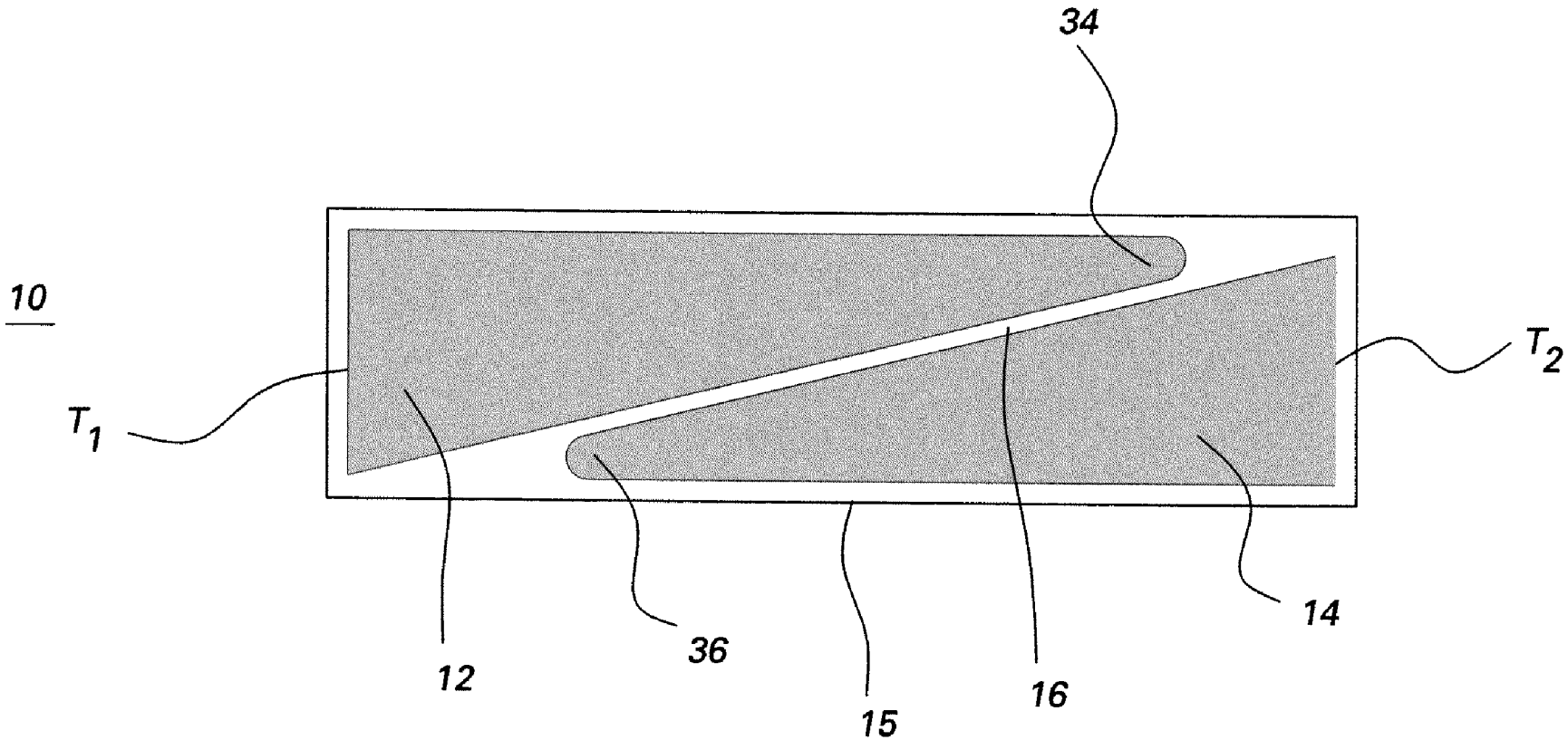
Figure 10:
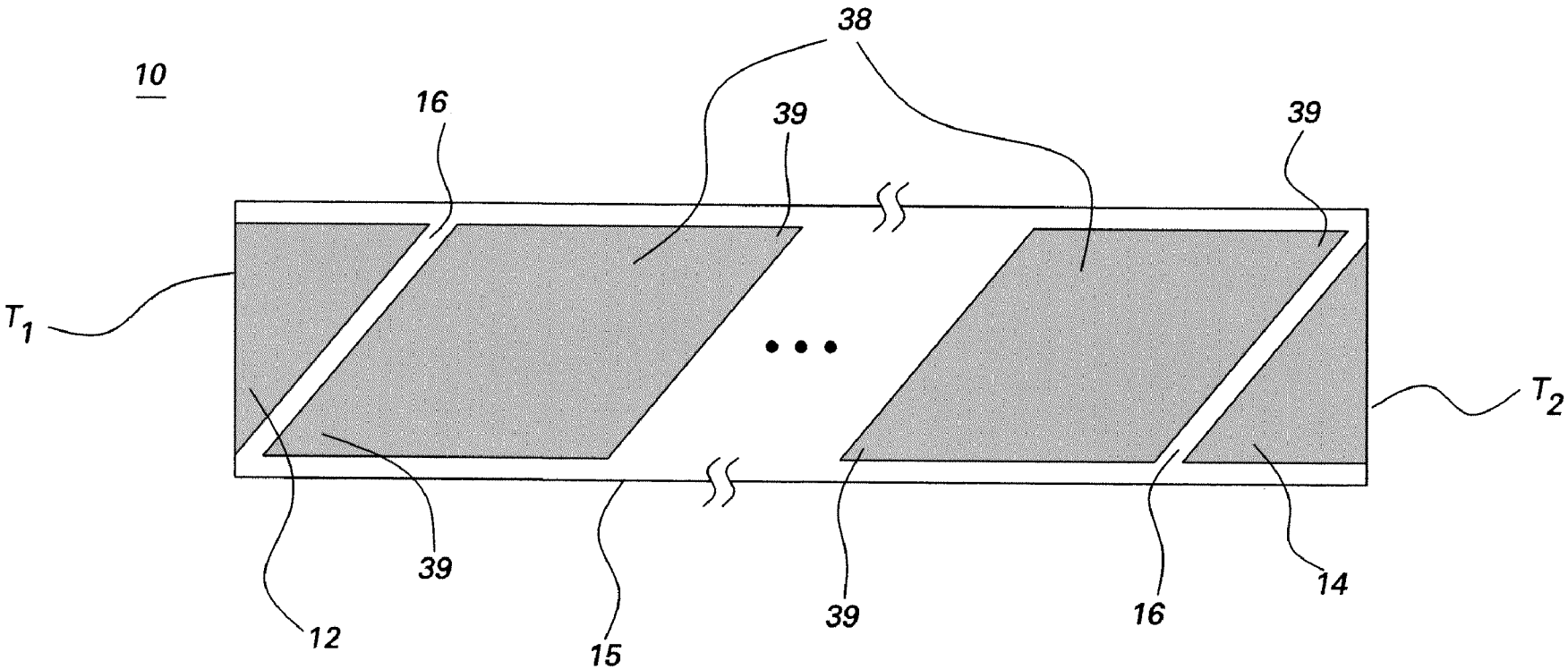
Figure 11:
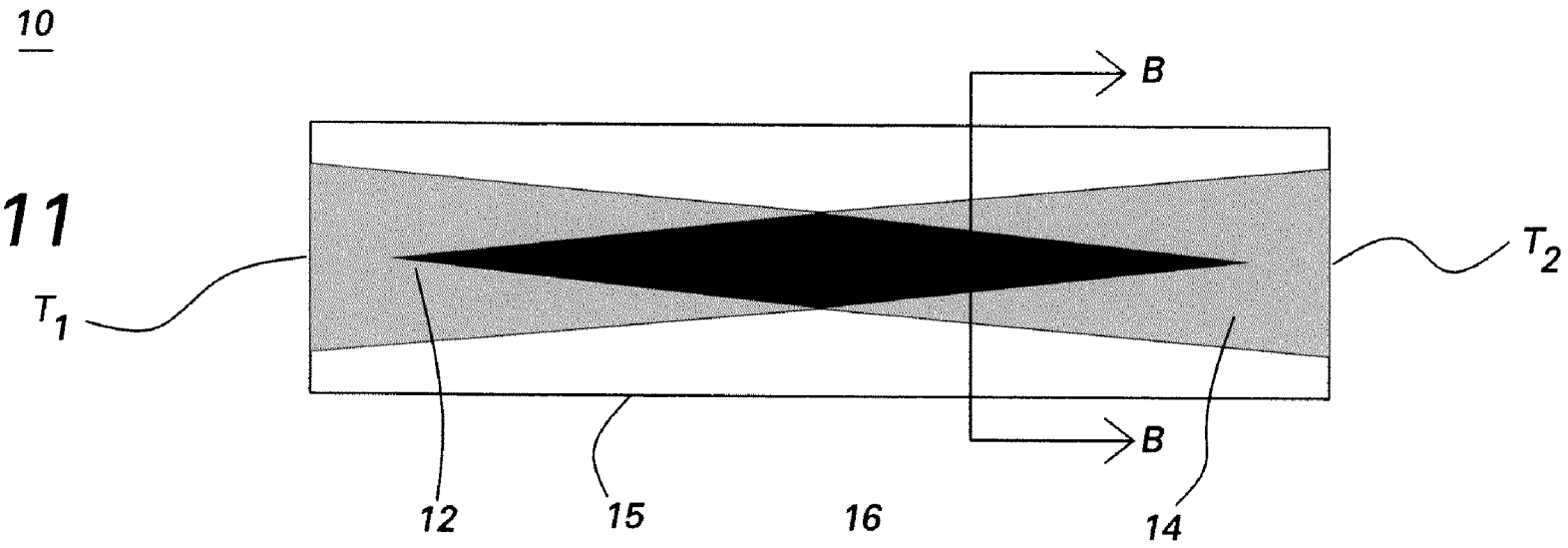
Figure 12:
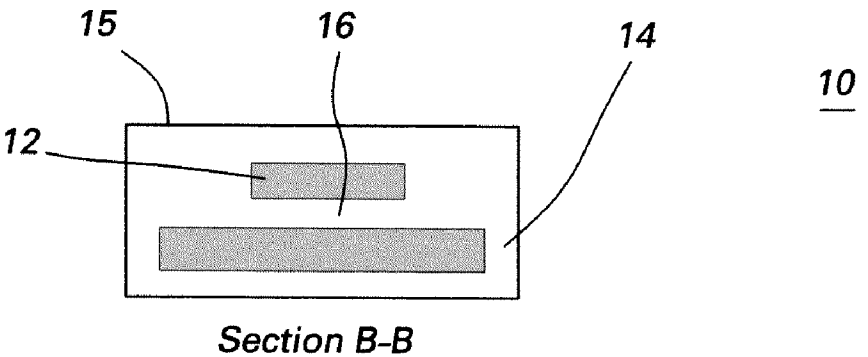
Figure 13:
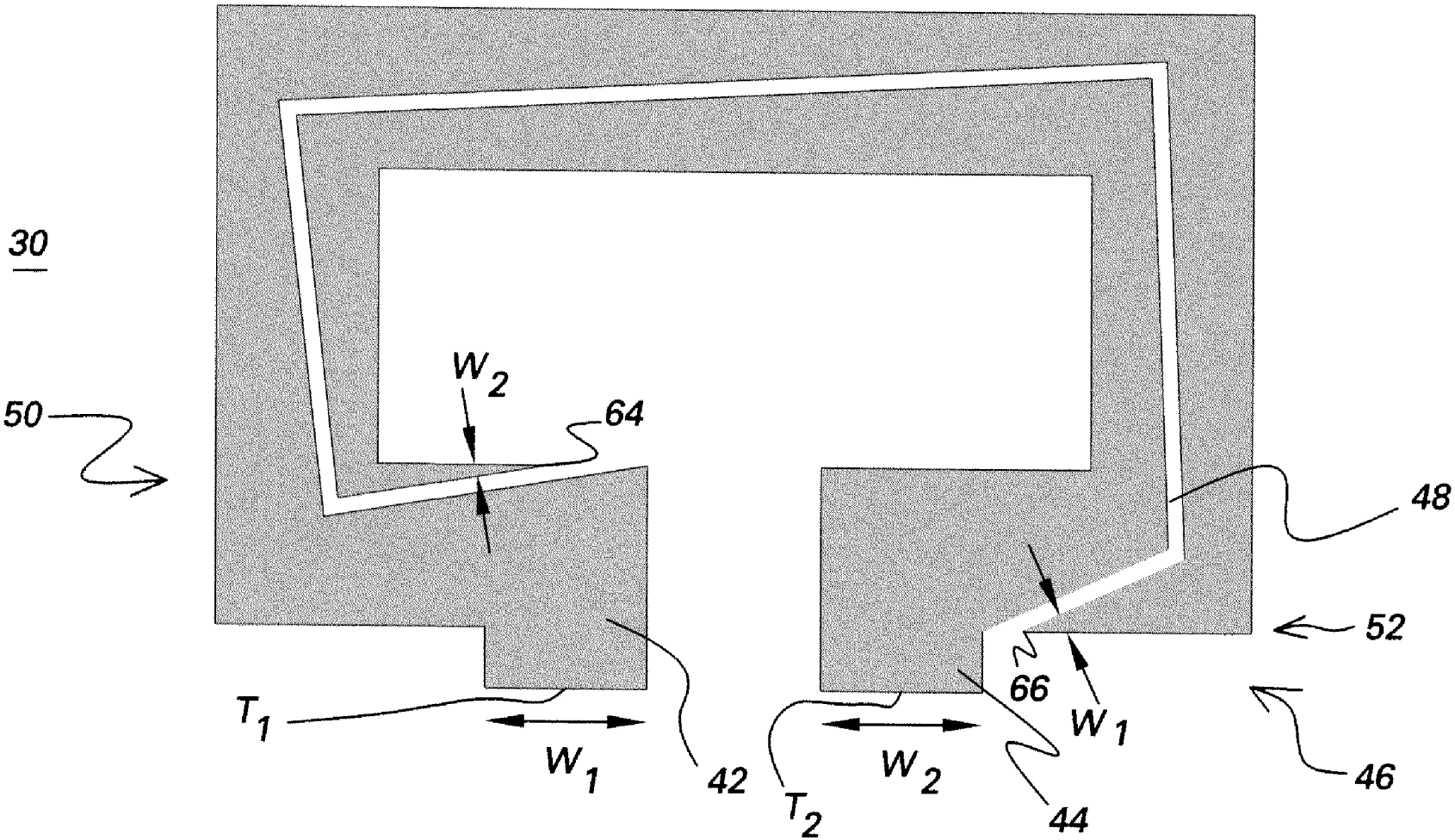
Figure 14:
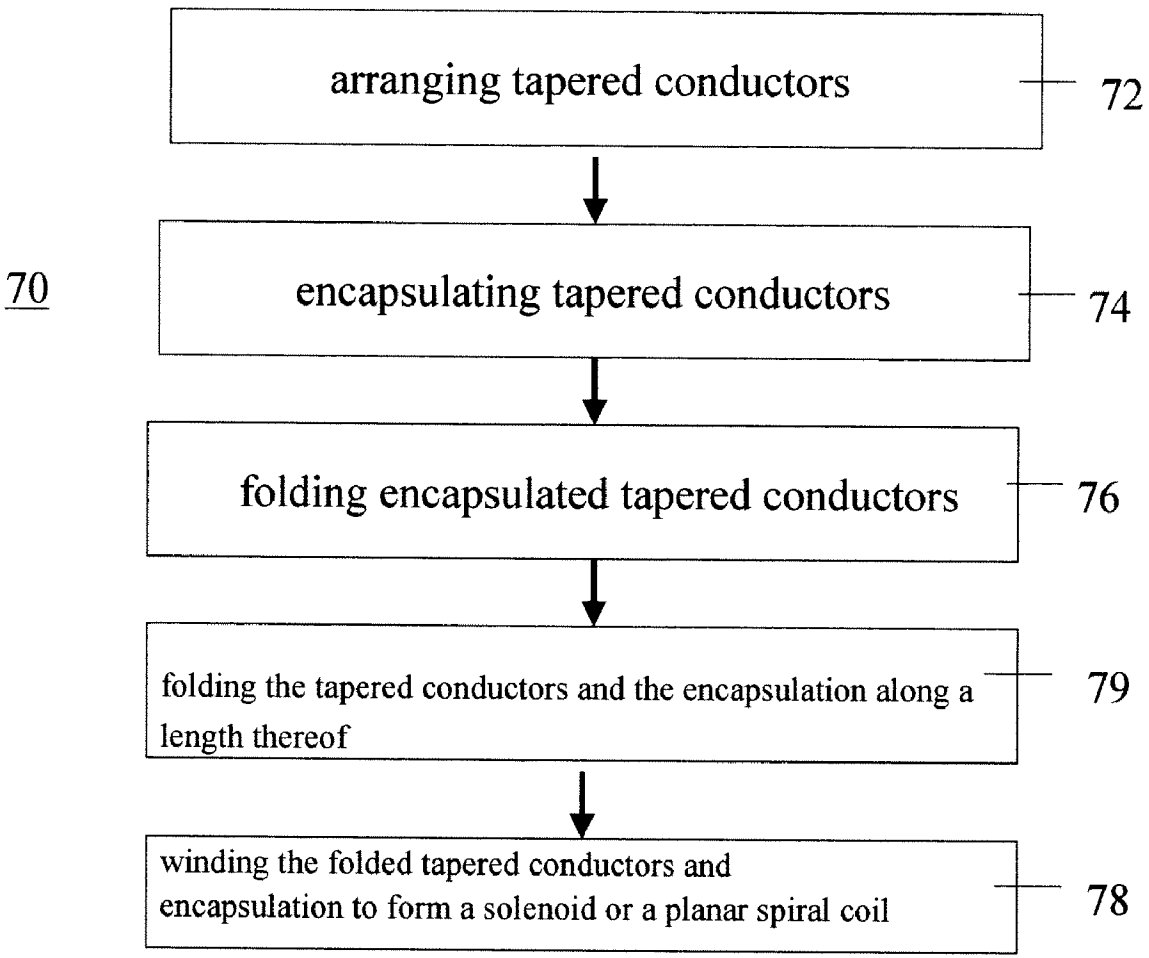
Figure 15:
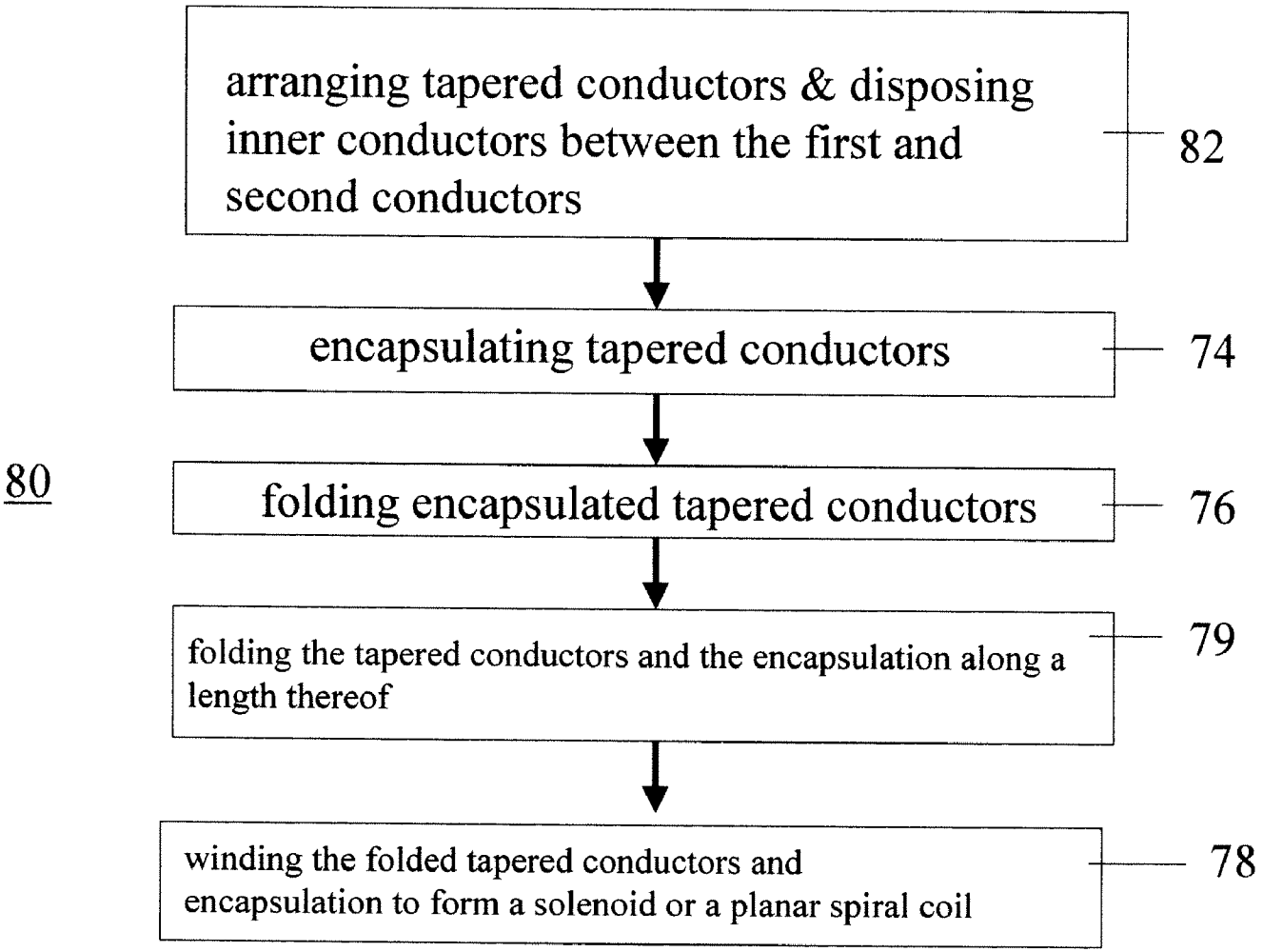
Figure 16:
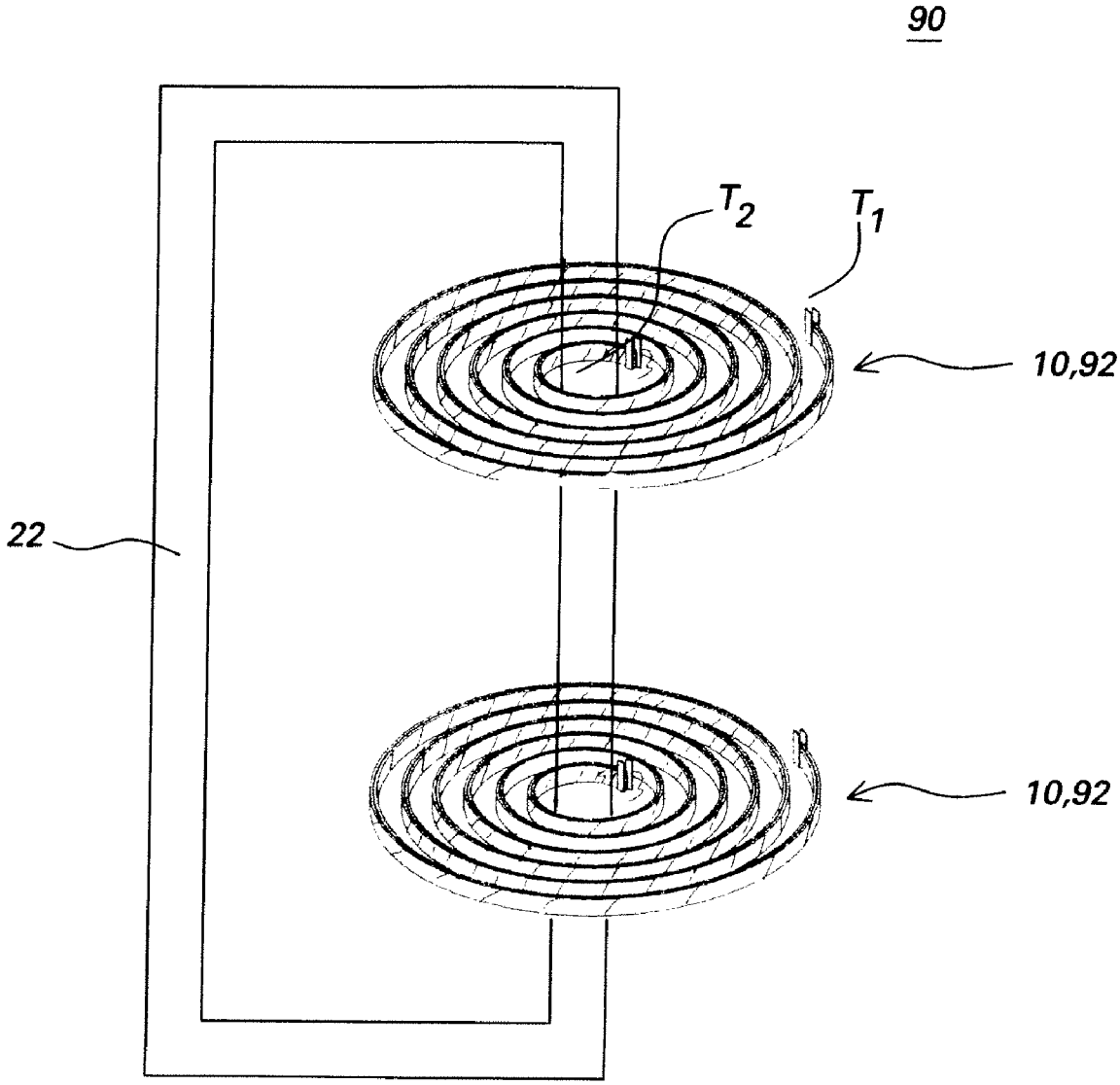
Figure 17:
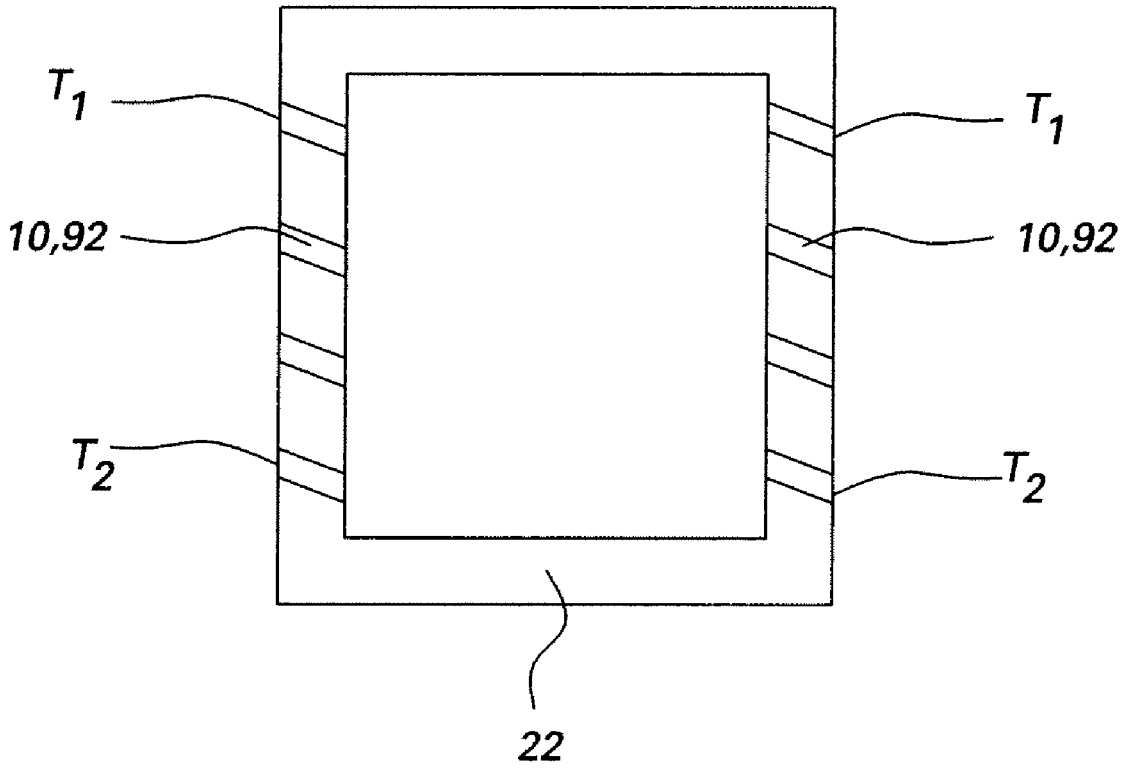

FIG. 9 schematically depicts tapered conductors with rounded tips;

FIG. 10 depicts an example configuration of tapered conductors and inner conductors;

FIG. 11 is a top view showing two tapered conductors that are arranged vertically;

FIG. 12 shows the vertically arranged tapered conductors of FIG. 11 in cross-sectional view;

FIG. 13 illustrates another exemplary capacitor and conductor component embodiment of the invention;

FIGS. 14 and 15 are flow charts illustrating a method embodiment of the invention; and FIGS. 16 and 17 illustrate transformer applications of the integrated inductor and capacitor components of the invention.

DETAILED DESCRIPTION

Figure 1:
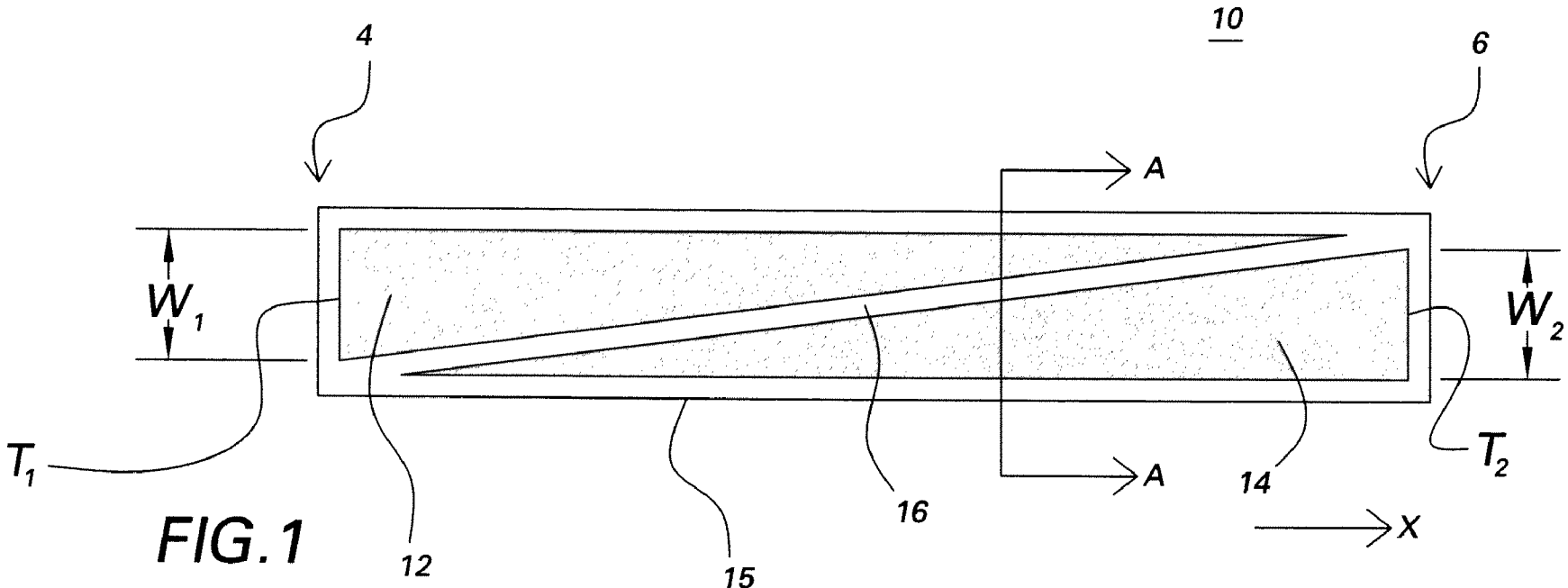
FIG. 1 illustrates an integrated inductor and capacitor component of the invention prior to folding.

An integrated inductor and capacitor component 10 is described with reference to FIGS. 1-12. As shown for example in FIG. 1, the integrated inductor and capacitor component 10 comprises a number of tapered conductors 12, 14. As indicated in FIG. 1, neighboring ones of the tapered conductors 12, 14 are separated by a gap 16 extending along a length of the component 10. A first one of the tapered conductors 12 is characterized by a first width w1 that is larger at a first end 4 of the component 10 and tapers along the length of the component 10 toward a second end 6 of the component 10. A second one of the tapered conductors 14 is characterized by a second width w2 that is larger at the second end 6 of the component 10 and tapers toward the first end 1 of the component 10. As indicated in FIG. 1, the widths w1, w2 of the two conductors vary as a function of x. In the illustrated example, the widths w1 at one end of the component 10 and w2 at the other end of the component 10 are the same. In other embodiments, the widths w1 and w2 may differ. It should be noted that the linear taper depicted in FIG. 1 is merely exemplary, and for other embodiments the taper of the conductors 12, 14 is curved in order to tailor the electric field and/or current density. Beneficially, by tapering the conductors, the current density is controlled along a length of the component. By maintaining a more uniform distribution of current density in the conductors, losses are reduced. At each end of component 10, a terminal $T_1$, $T_2$ is attached to allow electrical current from a circuit employing component 10 to flow thru component 10.

Figure 2:
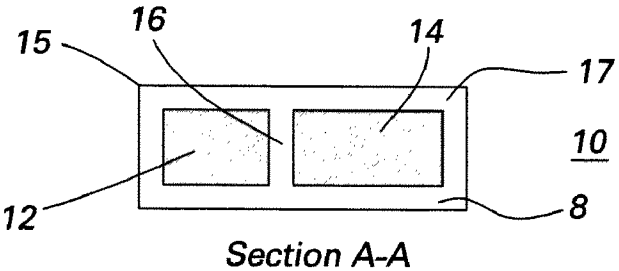
FIG. 2 is a cross sectional view of the component of FIG. 1.

FIG. 2 shows the conductors 12, 14 in cross-section. For the illustrated embodiment, the tapered conductors 12, 14 are coplanar, and the component 10 further comprises an encapsulation 15 that covers the tapered conductors 12, 14. Non-limiting examples of materials for encapsulation 15 include flexible organic polymers, such as polyimide, examples of which include materials marketed under the trade names Kapton® and Upilex®. Upilex® is commercially available from UBE Industries, Ltd., and Kapton® is commercially available from E. I. du Pont de Nemours and Company. Other exemplary flexible organic polymers include polyethersulfone (PES) from BASF, polyethyleneterephthalate (PET or polyester) from E. I. du Pont de Nemours and Company, polyethylenenaphthalate (PEN) from E. I. du Pont de Nemours and Company, and polyetherimide (PEI) from General Electric. PEI is commercially available from General Electric under the designation Ultem®. According to a particular embodiment, the encapsulation 15 comprises an upper and a lower encapsulating layer 17, 18 with the coplanar tapered conductors 12, 14 disposed between and effectively laminated by the encapsulating layers 17, 18. In other embodiments, the encapsulation comprises a sheath 15 surrounding the tapered conductors 12, 14. In certain embodiments, the encapsulation 15 comprises a dielectric material, or equivalently, an electrical insulator.

Figure 3:
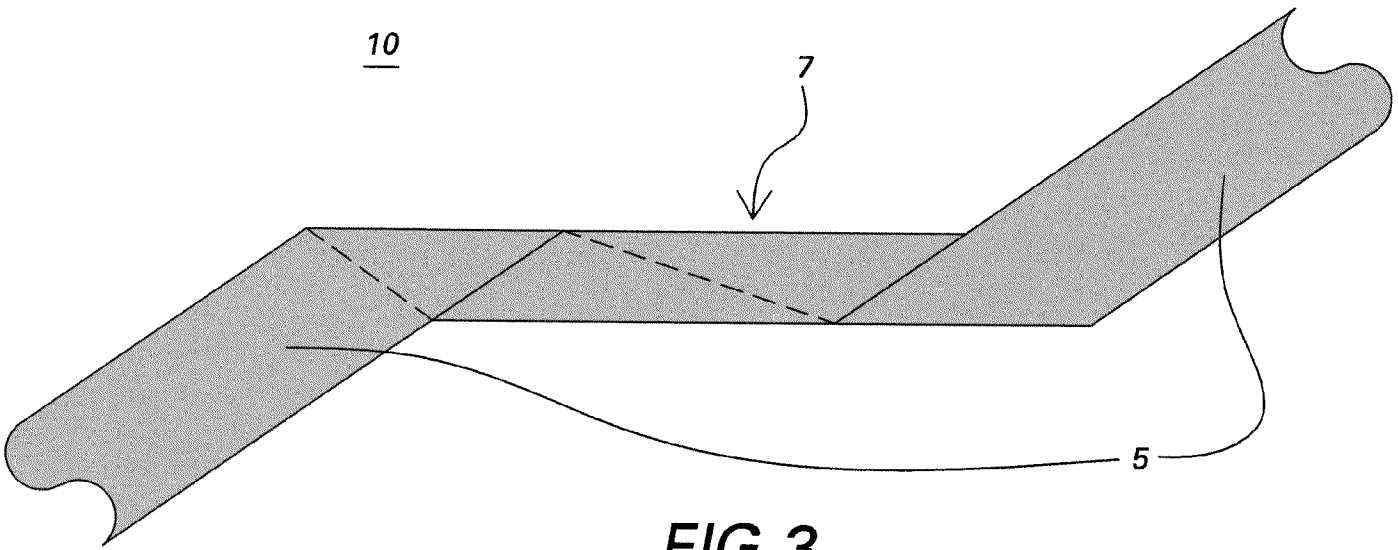
FIG. 3 depicts a partially folded integrated capacitor and conductor component.
Figure 4:
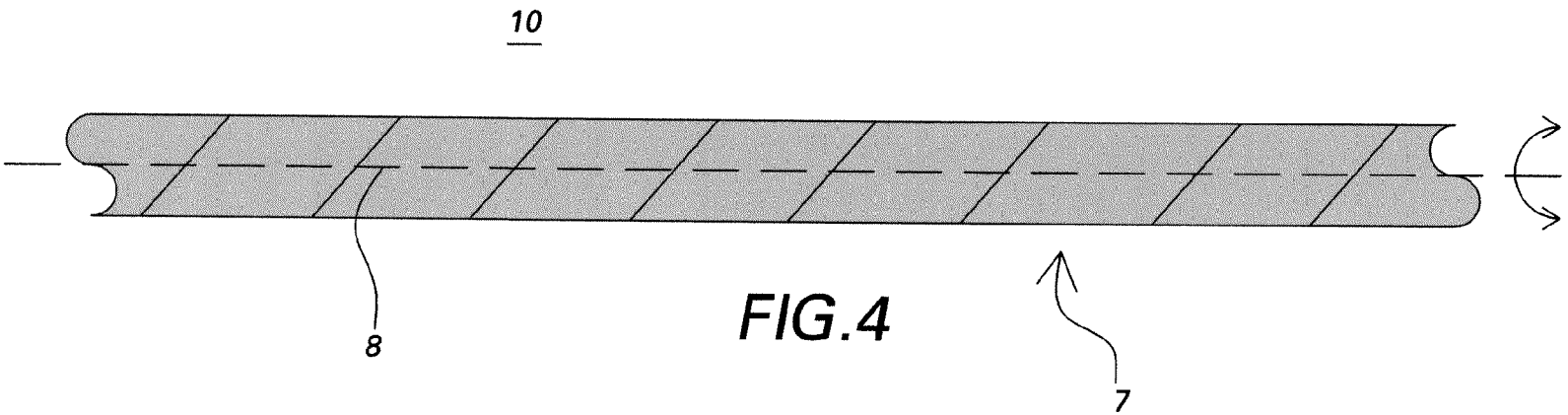
FIG. 4 depicts a folded integrated capacitor and conductor component.
Figure 5:
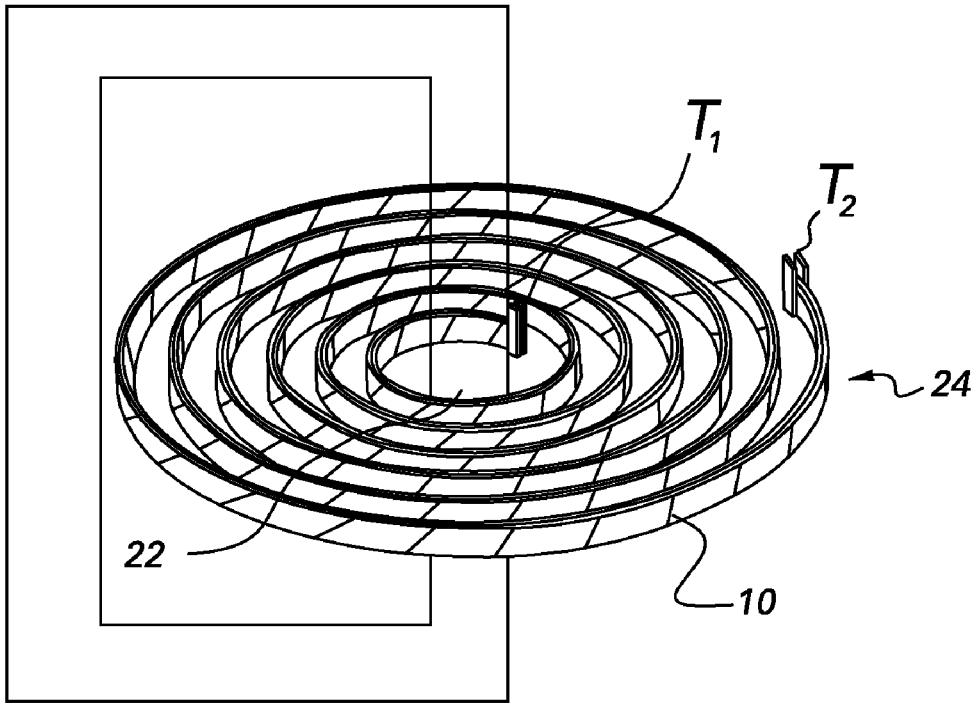
FIG. 5 illustrates a planar spiral coil arrangement of the inductor and capacitor component.
Figure 6:
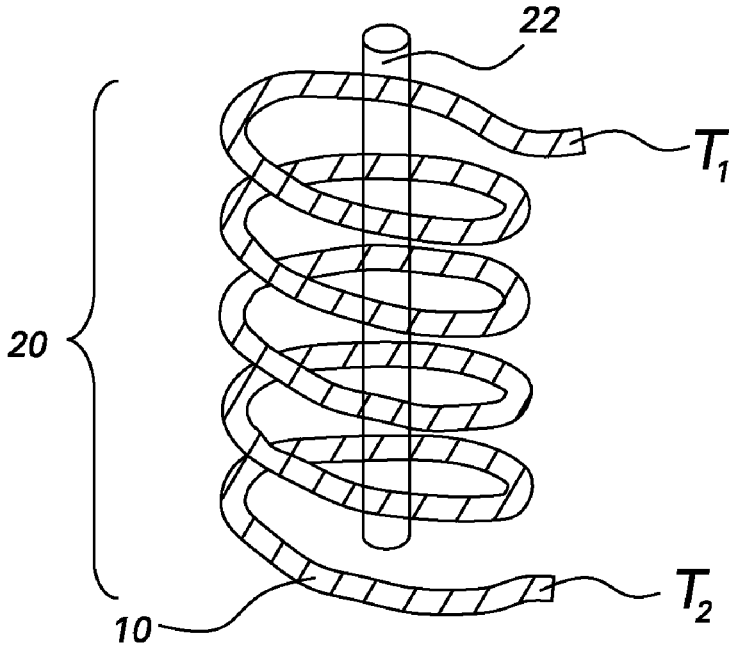
FIG. 6 illustrates a solenoid arrangement of the inductor and capacitor component.
Figure 7:
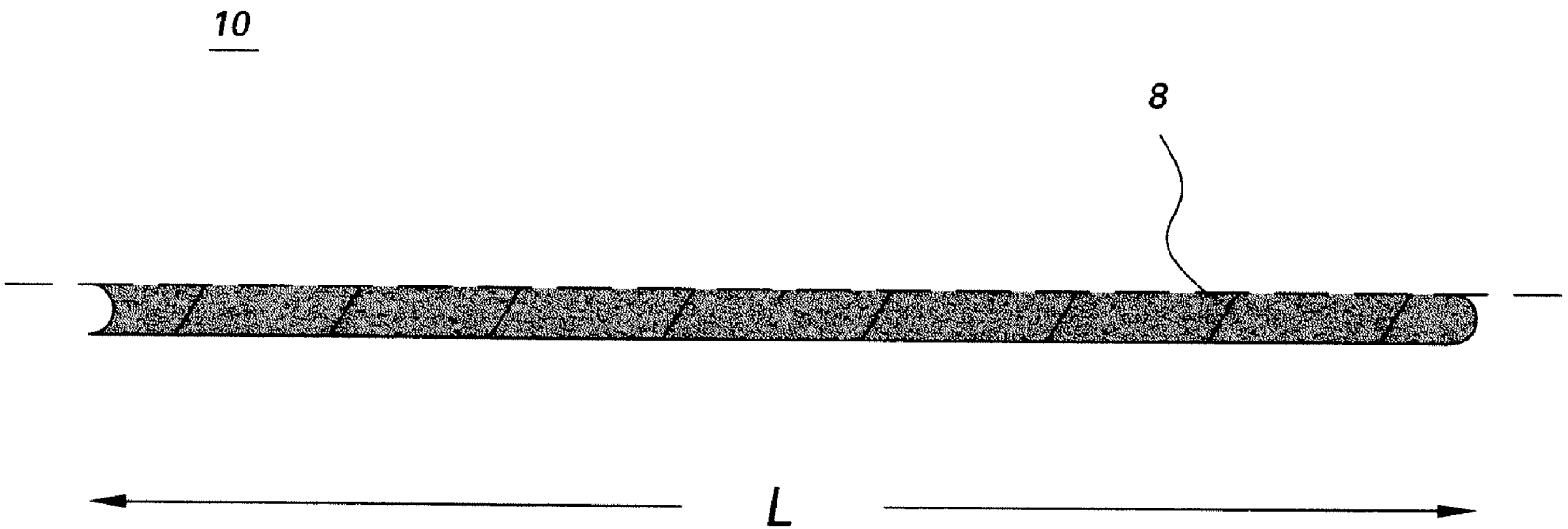
FIG. 7 depicts the folded integrated inductor and capacitor component further folded along a lengthwise axis.

As indicated for example, in FIGS. 3 and 4, the tapered conductors 12, 14 and the encapsulation 15 are folded to increase the series capacitance between the conductors for particular embodiments. FIG. 3 shows the component of FIGS. 1 and 2 in a partially folded arrangement, and FIG. 4 shows the component 10 in a folded configuration. Reference number 5 indicates the unfolded portions and reference number 7 indicates the folded portion of the component 10. Beneficially, by folding the conductors 12, 14, parallel plate capacitors are formed at the folds, such that the dominant capacitance for component 10 is a series capacitance. The folded component 10 can then be used to form a variety of electrical components. For example, for the embodiment illustrated in FIG. 6, the folded tapered conductors 12, 14 and encapsulation 15 are wound to form a solenoid 20. For the illustrated embodiment, the solenoid 20 is wound around a magnetic core 22 to concentrate the magnetic flux though the solenoid 20. The core 22 may be open as shown in FIG. 6 or could be closed, as shown for example in FIG. 5. For certain applications, the core comprises a flat disk (not shown) of magnetic material, such as but not limited to ferrite. In other embodiments (not shown), the solenoid 20 has an air core. For the embodiment depicted in FIG. 5, the folded tapered conductors 12, 14 and encapsulation 15 are wound to form a planar spiral coil 24. For the illustrated embodiment, the planar spiral coil 24 is wound around a magnetic core 22 to concentrate the magnetic flux though the planar spiral coil 24. For the illustrated embodiment, the magnetic core 22 is closed. However, in other embodiments, the magnetic core may be open, as shown for example in FIG. 6, or may comprise a flat disk of magnetic material. In other embodiments (not shown), the planar spiral coil 24 or solenoid 20 has an air core. As indicated in FIGS. 5 and 6, terminal $T_1$, $T_2$ are provided to allow electrical current from a circuit employing component 10 to flow thru component 10.

As discussed above, FIG. 4 shows the component 10 in a folded configuration. Dashed line 8 indicates a lengthwise folding axis 8. For the embodiment illustrated by FIG. 7, the tapered conductors 12, 14 and the encapsulation 15 are further folded along lengthwise folding axis 8. Beneficially, by folding the tapered conductors 12, 14 and the encapsulation 15 along the length L as indicated for example in FIG. 7, the thickness of the component 10 is increased without increasing the thickness of the tapered conductors. Further, this fact and the fact that the conductors occupy all areas of the final-ribbon cross-sectional area keep eddy current losses low. In addition, folding the component 10 lengthwise reduces the number of turns in the inductor, while increasing the cross-sectional area of component 10 in approximate inverse proportion to the change in the number of turns. This allows one to reduce the inductance without reducing inductor size or stored energy, and without increasing loss, which is desirable in certain applications. This lengthwise folding may be repeated to form ribbons of increasing thickness.

Figure 8:
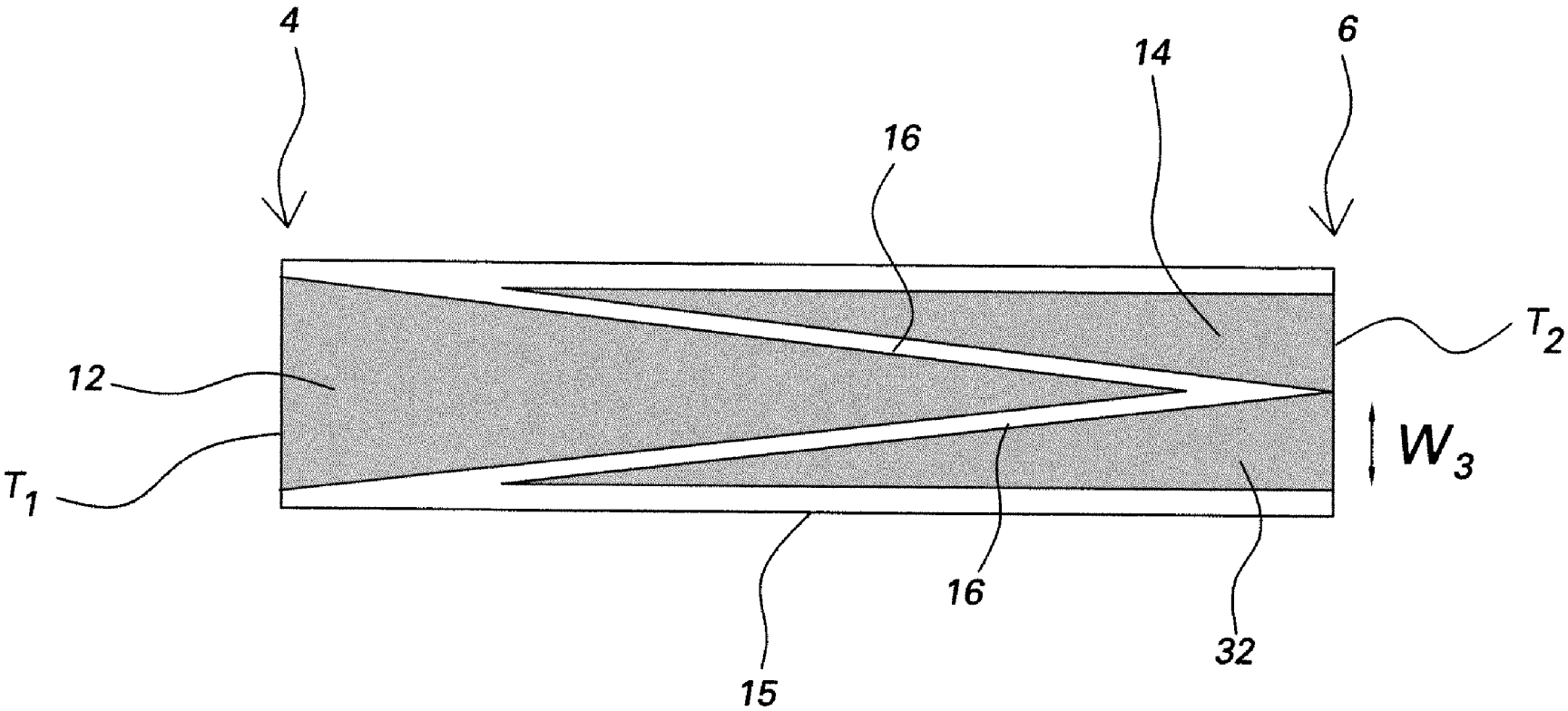
FIG. 8 depicts an exemplary multiple conductor embodiment of the integrated inductor and capacitor component.

A multiple conductor arrangement is discussed with reference to FIG. 8. As indicated, for example in FIG. 8, the integrated inductor and capacitor component 10 includes at least three tapered conductors 12, 14, 32. The third one of the tapered conductors 32 is characterized by a third width w3 that is larger at the second end 6 of the component 10 and tapers toward the first end 4 of the component 10. The first one of the tapered conductors 12 extends between the second and third ones of the tapered conductors 14, 32, as shown for example in FIG. 8. This arrangement can be extended to an increased number of tapered conductors. As indicated in FIG. 8, terminals $T_1$, $T_2$ are provided to allow electrical current from a circuit employing component 10 to flow thru component 10.

According to particular embodiments, each of the tapered conductors 12, 14 is rounded at a respective tip 34, 36 thereof, as shown for example in FIG. 9. Beneficially, by rounding the tips 34, 36 of the tapered conductors 12, 14, the electric field is reduced at the tips, thereby increasing the breakdown voltage for the component 10. FIG. 9 schematically depicts tapered conductors 12, 14 with rounded tips 34, 36. In addition, rounding the tips 34, 36 of the tapered conductors 12, 14 can also reduce the current crowding.

According to particular embodiments, the integrated inductor and capacitor component 10 further includes a number of inner conductors 38 disposed between the first and the second conductors 12, 14. FIG. 10 depicts an example configuration of the tapered conductors 12, 14 and the inner conductors 38. The inner conductors 38 need not be identical to one another. As shown, the inner conductors are separated from the first and second conductors 12, 14 by gaps 16. For the illustrated embodiment, the component 10 further includes an encapsulation 15 that covers the conductors 12, 14, 38. Further, terminals $T_1$, $T_2$ are provided, as indicated in FIG. 10, to allow electrical current from a circuit employing component 10 to flow thru component 10.

The arrangement of FIG. 10 can be folded, as shown in FIGS. 3 and 4, and the resulting cable can be used to form a solenoid or planar spiral coil, as discussed above with reference to FIGS. 5 and 6. In addition the tips 39 of the inner conductors 38 may be rounded, as discussed above with reference to FIG. 9, in order to reduce the electric fields at the tips, thereby increasing the breakdown voltages for the component 10. Further, and as noted above, rounding the tips can also reduce the current crowding. For longer cables or for arrangements with a large number of turns, the capacitance might be larger than desired for certain applications. By dividing the conductors into a number of conductors as shown for example in FIG. 10, the capacitance is reduced without changing the outer dimensions of the initial unfolded ribbon. Accordingly, this technique can be used to tailor the capacitance for the component 10 based on the application requirements.

For certain embodiments, of the integrated inductor and capacitor component 10, the tapered conductors 12, 14 are arranged vertically, as shown for example in FIGS. 11 and 12. FIG. 11 is a top view showing two tapered conductors 12, 14 that are arranged vertically. FIG. 12 shows the vertically arranged tapered conductors 12, 14 in cross-sectional view. The two conductors are electrically separated by a dielectric material. Vertical stacking may be used to enhance current density and capacitance. As shown in FIG. 11, terminals $T_1$, $T_2$ are provided to allow electrical current from a circuit employing component 10 to flow thru component 10.

Another integrated inductor and capacitor component 30 embodiment of the invention is described with reference to FIG. 13. As shown for example in FIG. 13, the integrated inductor and capacitor component 30 includes a number of tapered conductors 42, 44 arranged to form a loop 46. As indicated, neighboring ones of the tapered conductors are separated by a gap 48. A first one of the tapered conductors 42 is characterized by a first width w1 that is larger at a first end 50 of the loop and tapers along the length of the component toward a second end 52 of the loop. A second one of the tapered conductors 44 is characterized by a second width w2 that is larger at the second end of the loop 52 and tapers toward the first end 50 of the loop. As shown in FIG. 13, terminals $T_1$, $T_2$ are provided to allow electrical current from a circuit employing component 30 to flow thru component 30.

Although a single layer version is shown in FIG. 13 the arrangement is equally applicable to multilayer versions, in which multiple loops are stacked vertically. The component 30 (either single or multilayer versions) is particularly suited to planar component design methods, such as those commonly used to fabricate transformers and inductors as part of a printed circuit board. Moreover, although the loop shown in FIG. 13 is rectangular, the loop may take other shapes (both regular and irregular) and may be angular or smooth (for example a circular loop). In addition, although the conductors 42, 44 are shown as being continuous, they may be segmented in the manner of FIG. 10 and for the same reasons.

For the embodiment shown in FIG. 13, the tapered conductors 42, 44 are coplanar, and the component 30 further includes an encapsulation (not shown) that covers the tapered conductors. According to a particular embodiment, the encapsulation comprises an upper and a lower encapsulating layer (not shown) with the coplanar tapered conductors 42, 44 disposed between and effectively laminated by the encapsulating layers. In other embodiments, the encapsulation comprises a sheath surrounding the tapered conductors 42, 44. In certain embodiments, the encapsulation comprises a dielectric material. As discussed above with reference to FIG. 9, for certain applications it is desirable for each of the tapered conductors 42, 44 to be rounded at a respective tip 64, 66 thereof. As noted above, by rounding the tips 64, 66 of the tapered conductors 42, 44, the electric field is reduced at the tips, thereby increasing the breakdown voltage for the component 30. Although not expressly shown for the arrangement of FIG. 13, tapered conductors 12, 14 with rounded tips 34, 36 are schematically depicted in FIG. 9.

A method (indicated by reference number 70) for manufacturing an electrical component 10 is described with reference to FIGS. 14 and 15. As indicated in FIG. 14, the method includes at step 72 arranging a number of tapered conductors 12, 14, such that neighboring ones of the tapered conductors are separated by a gap 16 extending along a length of the electrical component. As discussed above with reference to FIG. 1, a first one of the tapered conductors 12 is characterized by a first width w1 that is larger at a first end 4 of the component and tapers along the length of the component toward a second end 6 of the component, and a second one of the tapered conductors 14 is characterized by a second width w2 that is larger at the second end of the component and tapers toward the first end of the component. For particular embodiments, the tapered conductors 12, 14 are arranged in a plane, as illustrated for example in FIG. 1. For other embodiments, the conductors 12, 14 are arranged vertically, as shown for example in FIGS. 11 and 12. In each if these embodiments, conductors 12, 14 are separated by a dielectric material. Optionally at step 74, the method further includes encapsulating the tapered conductors. As noted above, the encapsulation 15 comprises an insulator for certain embodiments and a dielectric in other embodiments. Optionally at step 76, the method further includes folding the tapered conductors 12, 14 and the encapsulation 15 to form a series capacitance between the tapered conductors, as discussed above with reference to FIGS. 3 and 4, for example. Optionally at step 78, the method further includes winding the folded tapered conductors 12, 14 and encapsulation 15 to form a solenoid 20 or a planar spiral coil 24, as discussed above with reference to FIGS. 5 and 6, for example. As noted above with reference to FIG. 6, in certain embodiments, the solenoid 20 is wound around a magnetic core 22 to concentrate the magnetic flux though the solenoid. In other embodiments, the solenoid 20 has an air core. Similarly, in certain embodiments, the planar spiral coil 24 is wound around a magnetic core 22 to concentrate the magnetic flux though the planar spiral coil 24, as shown for example in FIG. 5. In other embodiments, the planar spiral coil 24 has an air core. Optionally at Step 79, the method further includes folding the tapered conductors 12, 14 and the encapsulation 15 along a length thereof. Optional folding Step 79 is performed prior to winding Step 78, as indicated in FIGS. 14 and 15. As discussed above, by folding the tapered conductors 12, 14 and the encapsulation 15 along the length L as indicated for example in FIG. 7, the thickness of the cable is increased without increasing the thickness of the tapered conductors. In addition, folding the cable lengthwise reduces the number of turns in the inductor, thereby reducing the inductance, which is desirable in certain applications.

For the embodiment illustrated by FIG. 15, the method 80 further includes at step 82 disposing a number of inner conductors 38 between the first and the second conductors. FIG. 10 illustrates an example configuration of the tapered conductors 12, 14 and the inner conductors 38. The arrangement of FIG. 10 can be folded, as shown in FIGS. 3 and 4, and the resulting cable can be used to form a solenoid or planar spiral coil, as discussed above with reference to FIGS. 5 and 6. In addition the tips 39 of the inner conductors 38 may be rounded, as discussed above with reference to FIG. 9, in order to reduce the electric fields at the tips, thereby increasing the breakdown voltages for the component 10. For longer cables or for arrangements with a large number of turns, the capacitance might be larger than desired for certain applications. By dividing the conductors into a number of conductors as shown for example in FIG. 10, the integrated capacitor is changed into a number of series capacitors of reduced value, so that the total capacitance seen at the terminals is reduced. Accordingly, this technique can be used to tailor the capacitance for the component 10 based on the application requirements.

The integrated inductor and capacitor components 10, 30 described above can be used in a variety of transformer applications where one or more of these cables are magnetically coupled and can be used in conjunction with conventional cables. FIGS. 16 and 17 illustrate a few example transformer applications for the integrated inductor and capacitor components. FIG. 16 depicts a transformer 90 having two integrated inductor and capacitor components 10 arranged vertically with a closed magnetic core. The integrated inductor and capacitor components 10 are magnetically coupled to one another. For the example arrangement shown in FIG. 16, the components 10 are arranged in spiral coils. In other examples, the components are arranged as solenoids. The number of components 10 shown (two in FIG. 16) is merely one possible example. In addition, although the components 10 are shown in FIG. 16 as being arranged around a closed, magnetic core 22, they may also be arranged around open magnetic cores (as shown in FIG. 6, for example) or with an air core.

FIG. 17 depicts a transformer 90 having two integrated inductor and capacitor components 10 arranged on different legs of a closed, magnetic core. The integrated inductor and capacitor components 10 are magnetically coupled to one another. For the illustrated example, the components are arranged as solenoids. In other examples, the components are arranged as spiral coils. The number of components 10 shown (two in FIG. 17) is merely one possible example. In addition, although the components 10 are shown in FIG. 17 as being arranged around a closed, magnetic core 22, they may also be arranged around open magnetic cores (as shown in FIG. 6, for example) or with an air core.

In other examples, one of the components 10 in FIGS. 16 and 17 is replaced by a conventional cable component 92 such that the integrated inductor and capacitor component 10 and the cable component 92 are magnetically coupled.

The integrated inductor and capacitor components and methods of assembly of the present invention possess many advantages relative to prior integrated LC component implementations. For example, the integrated inductor and capacitor component of the present invention occupy the space of a single component (capacitor or inductor), while providing the utility of both capacitors and inductors with reduced AC losses relative to known methods. Moreover, the folded ribbon facilitates the use of thinner conductors for a given current density, thereby reducing AC losses and enabling the scaling of the integrated inductor and capacitor components to higher power than would be practical with known components. Further, the methods of assembly facilitate low cost manufacture.

Another benefit of this structure is that when this cable is used in resonant applications the distributed capacitance also distributes the voltage and significantly reduces the voltage across the capacitor as compared to an equivalent discrete structure.

Although only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An integrated inductor and capacitor component comprising:

a plurality of tapered conductors, wherein neighboring ones of the tapered conductors are separated by a gap extending along a length of the component, wherein a first one of the tapered conductors is characterized by a first width w1 that is larger at a first end of the component and tapers along the length of the component toward a second end of the component, and wherein a second one of the tapered conductors is characterized by a second width w2 that is larger at the second end of the component and tapers toward the first end of the component.

2. The integrated inductor and capacitor component of claim 1, wherein the tapered conductors are coplanar, the component further comprising an encapsulation that covers the tapered conductors.

3. The integrated inductor and capacitor component of claim 2, wherein the encapsulation comprises a dielectric material.

4. The integrated inductor and capacitor component of claim 2, wherein the tapered conductors and the encapsulation are folded to form a series capacitance between the tapered conductors.

5. The integrated inductor and capacitor component of claim 4, wherein the folded tapered conductors and encapsulation are wound to form a solenoid.

6. The integrated inductor and capacitor component of claim 4, wherein the folded tapered conductors and encapsulation are wound to form a planar spiral coil.

7. The integrated inductor and capacitor component of claim 4, wherein the tapered conductors and the encapsulation are further folded along a length thereof.

8. The integrated inductor and capacitor component of claim 1, comprising at least three tapered conductors, wherein a third one of the tapered conductors is characterized by a third width w3 that is larger at the second end of the component and tapers toward the first end of the component, and wherein the first one of the tapered conductors extends between the second and third ones of the tapered conductors.

9. The integrated inductor and capacitor component of claim 1, wherein each of the tapered conductors is rounded at a respective tip thereof.

10. The integrated inductor and capacitor component of claim 1, further comprising a plurality of inner conductors disposed between the first and the second conductors.

11. The integrated inductor and capacitor component of claim 1, wherein each of the tapered conductors has at least one planar surface, and wherein the tapered conductors are arranged vertically with the planar surfaces parallel.

12. An integrated inductor and capacitor component comprising:

a plurality of tapered conductors arranged to form a loop, wherein neighboring ones of the tapered conductors are separated by a gap, wherein a first one of the tapered conductors is characterized by a first width w1 that is larger at a first end of the loop and tapers along the length of the component toward a second end of the loop, and wherein a second one of the tapered conductors is characterized by a second width w2 that is larger at the second end of the loop and tapers toward the first end of the loop.

13. The integrated inductor and capacitor component of claim 12, wherein the tapered conductors are coplanar, the component further comprising an encapsulation that covers the tapered conductors.

14. The integrated inductor and capacitor component of claim 13, wherein the encapsulation comprises a dielectric material.

15. The integrated inductor and capacitor component of claim 12, wherein each of the tapered conductors is rounded at a respective tip thereof.

16. A method for manufacturing an electrical component, the method comprising arranging a plurality of tapered conductors such that neighboring ones of the tapered conductors are separated by a gap extending along a length of the electrical component, wherein a first one of the tapered conductors is characterized by a first width w1 that is larger at a first end of the component and tapers along the length of the component toward a second end of the component, and wherein a second one of the tapered conductors is characterized by a second width w2 that is larger at the second end of the component and tapers toward the first end of the component.

17. The method of claim 16, wherein the tapered conductors are arranged in a plane, the method further comprising encapsulating the tapered conductors.

18. The method of claim 17, further comprising folding the encapsulated tapered conductors to form a series capacitance between the tapered conductors.

19. The method of claim 18, further comprising winding the folded, encapsulated tapered conductors to form a solenoid.

20. The method of claim 18, further comprising winding the folded, encapsulated tapered conductors to form a planar spiral coil.

21. The method of claim 18, further comprising folding the tapered conductors and the encapsulation along a length thereof.

22. The method of claim 16, further comprising disposing a plurality of inner conductors between the first and the second conductors.

23. The method of claim 16, wherein the tapered conductors are arranged vertically.

24. A transformer comprising at least one integrated inductor and capacitor component having:

a plurality of tapered conductors, wherein neighboring ones of the tapered conductors are separated by a gap extending along a length of the component, wherein a first one of the tapered conductors is characterized by a first width w1 that is larger at a first end of the component and tapers along the length of the component toward a second end of the component, and wherein a second one of the tapered conductors is characterized by a second width w2 that is larger at the second end of the component and tapers toward the first end of the component.

25. The transformer of claim 24 comprising a plurality of integrated inductor and capacitor components, wherein the integrated inductor and capacitor components are magnetically coupled to one another.

26. The transformer of claim 24, further comprising at least one cable component, wherein the integrated inductor and capacitor component and the cable component are magnetically coupled.

* * * * *

UNITED STATES PATENT AND TRADEMARK OFFICE

CERTIFICATE OF CORRECTION

PATENT NO. : 7,626,801 B2
APPLICATION NO. : 11/749174
DATED : December 1, 2009
INVENTOR(S) : Glaser et al.

It is certified that error appears in the above-identified patent and that said Letters Patent is hereby corrected as shown below:

In Column 3, Line 62, delete "though" and insert -- through --, therefor.

In Column 4, Line 5, delete "though" and insert -- through --, therefor.

In Column 6, Line 42, delete "though" and insert -- through --, therefor.

In Column 6, Line 46, delete "though" and insert -- through --, therefor.

Signed and Sealed this

Fourteenth Day of September, 2010

David J. Kappos

David J. Kappos
*Director of the United States Patent and Trademark Office*